US008062443B2

(12) United States Patent
Fronabarger et al.

(10) Patent No.: US 8,062,443 B2
(45) Date of Patent: Nov. 22, 2011

(54) LEAD-FREE PRIMERS

(75) Inventors: John W. Fronabarger, Sun Lakes, AZ (US); Michael D. Williams, Gilbert, AZ (US); Magdy M. Bichay, Springfield, VA (US)

(73) Assignees: Pacific Scientific Energetic Materials Company, Chandler, AZ (US); The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 12/397,420

(22) Filed: Mar. 4, 2009

(65) Prior Publication Data

US 2009/0223401 A1 Sep. 10, 2009

Related U.S. Application Data

(60) Provisional application No. 61/035,100, filed on Mar. 10, 2008, provisional application No. 61/113,653, filed on Nov. 12, 2008.

(51) Int. Cl.

| | |
|---|---|
| ***C06B 25/00*** | (2006.01) |
| ***C06B 25/34*** | (2006.01) |
| ***D03D 23/00*** | (2006.01) |
| ***D03D 43/00*** | (2006.01) |

(52) U.S. Cl. ..... 149/109.2; 149/88; 149/92; 149/109.4

(58) Field of Classification Search ..... 149/109.2, 149/88, 92, 109.44

See application file for complete search history.

(56) References Cited

U.S. PATENT DOCUMENTS

| | | | | |
|---|---|---|---|---|
| 2,066,954 | A | 1/1937 | Herz | |
| 2,480,141 | A | 8/1949 | King | |
| 3,351,015 | A | 11/1967 | Wallack | |
| 3,486,453 | A * | 12/1969 | Smallwood | 102/204 |
| 3,634,510 | A | 1/1972 | Schmerling | |

(Continued)

FOREIGN PATENT DOCUMENTS

| | | |
|---|---|---|
| EP | 0941180 | 9/1999 |

(Continued)

OTHER PUBLICATIONS

Barsan & Miller, Health Hazard Evaluation Report, HETA Report #91-0346-2572, FBI Academy, Quantico, Virginia, pp. ii-iv and 1-33 (Apr. 1996).

(Continued)

*Primary Examiner* — James McDonough

(74) *Attorney, Agent, or Firm* — Kilpatrick Townsend & Stockton LLP

(57) ABSTRACT

Embodiments of the present subject matter provide an improved percussion primer composition and improved hot-wire igniter acceptor, wherein lead styphnate is replaced with a lead-free material, 4,6-dinitro-7-hydroxybenzofuroxan, potassium salt (KDNP). Embodiments of the percussion primer composition include KDNP, a sensitizer, an oxidizer, calcium silicide, a fuel, and a binder. Sensitizers may include tetracene. Oxidizers may include alkali or alkaline earth nitrates, oxides, or peroxides (such as barium nitrate). Fuel materials may include metals, metal sulfides, or other non-metallic materials. Common binders may include nitrocellulose based shellacs, gum arabic/poly vinyl alcohol mixtures, and guar gum/poly vinyl alcohol mixtures. Embodiments of the hot-wire igniter device include a bridgewire, an acceptor, and an output, where KDNP is the acceptor. Power supply may be in the form of constant current/voltage or current flow from a capacitor discharge. Certain embodiments utilize a variety of output formulations, such as $BKNO_3$, black powder, and Red Dot double base propellant.

19 Claims, 2 Drawing Sheets

4,6-dinitro-7-hydroxybenzofuroxan, potassium salt (KDNP).

U.S. PATENT DOCUMENTS

| | | | | |
|---|---|---|---|---|
| 3,791,301 | A | 2/1974 | La Costa | |
| 4,093,623 | A | 6/1978 | Gilligan et al. | |
| 4,094,879 | A | 6/1978 | Bates et al. | |
| 4,133,707 | A | 1/1979 | Andrew | |
| 5,039,812 | A * | 8/1991 | Norris | 548/126 |
| 5,417,160 | A | 5/1995 | Mei et al. | |
| 5,610,367 | A * | 3/1997 | Erickson et al. | 149/35 |
| 5,717,159 | A | 2/1998 | Dixon et al. | |
| 5,831,208 | A | 11/1998 | Erickson | |
| 6,478,903 | B1 | 11/2002 | John, Jr. et al. | |
| 7,056,401 | B2 | 6/2006 | Galluzzi | |
| 7,833,330 | B2 | 11/2010 | Fronabarger et al. | |
| 2002/0143189 | A1 * | 10/2002 | Sonti | 548/126 |
| 2005/0183805 | A1 * | 8/2005 | Pile et al. | 149/39 |
| 2006/0030715 | A1 | 2/2006 | Hiskey et al. | |
| 2007/0161801 | A1 | 7/2007 | Renz et al. | |
| 2009/0069566 | A1 | 3/2009 | Fronabarger et al. | |
| 2010/0280254 | A1 | 11/2010 | Fronabarger et al. | |

FOREIGN PATENT DOCUMENTS

| | | |
|---|---|---|
| GB | 1106277 | 3/1968 |
| WO | WO-9711926 | 4/1997 |
| WO | WO-9902470 | 1/1999 |
| WO | WO9944968 | 9/1999 |
| WO | WO2008048351 | 4/2008 |
| WO | WO-2009/114347 | 9/2009 |
| WO | WO-2010085583 A1 | 7/2010 |

OTHER PUBLICATIONS

Qualification and Final (Type) Qualification Procedures for Navy Explosives, Naval Sea Systems Command Instruction #8020.5C, ("NAVSEAINST 8020.5C"), 40 pages (May 5, 2000).

Fourth Report on the Investigation of the Alternatives to Lead Azide and Lead Styphnate, NSWC-IH contract #N00174-06-C-0079, pp. 1-23 (Sep. 20, 2007).

Molecular Basis for Secondary Flash Suppression, Hastie, J.W., Bonnell, D.W. and Schenck, P.K., U.S. Army Research Office, Document ARO 18375-CH, MIPR 102-84, 26 pages (Jul. 1, 1986).

International Search Report and Written Opinion in International Application No. PCT/US07/04846.

Talawar, et al., Energetic co-ordination compounds: synthesis, characterization and thermolysis studies on bis-(5-nitro-*2H*-tetrazolato-$N^2$)tetraammine cobalt(III) perchlorate (BNCP) and its new transition metal (Ni/Cu/Zn) perchlorate analogues,'*J. Hazardous Materials*, A120, pp. 25-35 (2005).

Patani, et al., 'Bioisosterism : A Rational Approach in Drug Design,' *Chem. Rev.*, 96(8) :3147-3176 (1996).

International Search Report and Written Opinion dated Sep. 2, 2009 in related Application No. PCT/US2009/035952.

Fronabarger, J W et al., ""Preparation characterization and output testing of salts of", 7-hydroxy-4,6-dinitrobenzofuroxan" Safe Journal Spring 2007 Survival and Flight Equipment Association (SAFE) US, vol. 35, No. 1, Apr. 2007 ,pp. 14-18, XP008110604 1, Apr. 2007.

Spear, R J et al., "Structure and Properties of the Potassium Hydroxide-Dinitrobenzofuro xan Adduct (KDNBF) and Related Explosive Salts." Propellants, Explosives, Pyrotechnics, vol. 8, No. XP008110603 3, Jun. 1983 , 85-88.

International Search Report and Written Opinion dated Apr. 12, 2010 in International Application No. PCT/US2010/021695.

International Preliminary Report on Patentability dated Aug. 4, 2011 in International Application No. PCT/US2010/021695.

* cited by examiner 4,6-dinitro-7-hydroxybenzofuroxan, potassium salt (KDNP).

LEAD-FREE PRIMERS

CROSS REFERENCE TO RELATED APPLICATIONS

This application is related to and claims priority benefits from U.S. Provisional Application Ser. No. 61/035,100, filed on Mar. 10, 2008, entitled LEAD-FREE PERCUSSION PRIMER MIXTURE, and U.S. Provisional Application Ser. No. 61/113,653, filed Nov. 12, 2008, entitled LEAD-FREE PRIMARY EXPLOSIVE FOR HOT WIRE APPLICATIONS. The '100 and '653 applications are hereby incorporated by reference herein in their entireties.

STATEMENT OF GOVERNMENT SUPPORT

This invention was made in part with U.S. government support under Contract Nos. N00174-99-C-0033 and N00174-06-00079 awarded by the United States of America for the Department of the Navy. The government has certain rights in this invention.

FIELD OF THE INVENTION

This invention relates to improved lead-free energetic compositions, which are suitable for use in percussion primers and hot-wire applications.

BACKGROUND OF THE INVENTION

Primary explosives are sensitive explosive materials that are used, in relatively small quantities, to initiate a secondary or main explosive charge. Primary explosives are used in percussion primers and electric primers (hot-wire igniters) to initiate an explosion. Percussion primers contain a small amount of a sensitive ignition mix that is activated by a strike from a firing pin and are used for the direct ignition of a propellant powder as in small arms ammunition. Current non-corrosive percussion primer compositions consist of mixtures of lead styphnate, barium nitrate, calcium silicide, antimony sulphide and tetracene (1-amino-1-[(1H-tetrazol-5-yl)azo]guanidine hydrate) in varying amounts. Other primer compositions are known (e.g. FA70, FA90, etc.) and contain various other materials, but most widely used mixtures remain based on lead-containing components such as lead styphnate (e.g. FA956, 5086).

This well-known deflagrating material is undesirable from an environmental standpoint since its use and manufacture can contribute to or cause lead contamination. Tons of this toxic material are used annually in manufacture of military and commercial percussion primers and lead exposure via the primer mix itself or combustion products is common. The majority (>95%) of primer use in both the military and domestic police forces is for training purposes in "friendly" areas. A 1991 survey found that employees who had just cleaned a range operated by the FBI in Quantico, Va., had levels of lead in their blood almost 10 times as high as US government health limits. See Barsan, M. E. & Miller, A. *Lead Health Hazard Evaluation* HETA Report #91-0346-2572. As a result, both the EPA and the FBI have designated lead as a primer ingredient that requires replacement. Lead-free primer compositions currently in use contain diazodinitrophenol (DDNP). However, these mixes, due to concerns with shelf-life and reliability, do not meet requirements for use in military applications. See U.S. Pat. Nos. 5,417,160; 5,831,208; 6,478,903; and 7,056,401; and Publication No. WO/1999/144968. Alternatively, as described in U.S. Pat. No. 5,717,159, a new primer composition based on metastable interstitial composite (MIC) technology is known.

Hot-wire igniter systems (FIG. 1) are commonly used in both military and commercial applications as a method of initiation, wherein application of current from a power source is used to heat a filament and the heat is transferred to a reactive material (acceptor) to provide energy sufficient to ignite an output.

A hot-wire igniter is generally composed of a filament or bridgewire of high resistance, which is situated inside a composition that will ignite when a suitable current is applied. Common bridgewire materials are nichrome (tophet a or c) and stainless steel, which is composed of nickel, chromium and/or iron in various ratios. These materials have high heat resistance and will withstand high temperatures (~1400° C.) before melting. They can therefore easily and rapidly transfer this heat to an ignitable composition such as a pyrotechnic or explosive charge.

Common materials that serve as acceptors of the bridgewire energy are lead styphnate, normal ("NLS") or basic ("BLS"), and a number of pyrotechnics, such as ZPP (zirconium/potassium perchlorate). In these cases, the heat transferred from the bridgewire exceeds the ignition temperature of the acceptor and is sufficient to cause deflagration of that material. The energy of this deflagration may be used to further ignite a pyrotechnic, propellant or explosive output.

SUMMARY OF THE INVENTION

Embodiments of the present invention provide an improved percussion primer composition and improved hot-wire igniter acceptor, wherein lead styphnate or similar material is replaced with a lead-free material, 4,6-dinitro-7-hydroxybenzofuroxan, potassium salt (KDNP, FIG. 2).

Embodiments of the percussion primer composition may include KDNP, a sensitizer, an oxidizer, calcium silicide, a fuel, and a binder. KDNP typically is used as a drop in replacement at the same weight percentage for the primary explosive, which historically has been lead styphnate. KDNP may be present in a range of about 10 to 50 percent by weight based on the total weight of the composition.

Tetracene may be utilized as a sensitizer, where the sensitizer may be present in a range of about 2 to 10 percent by weight based on the total weight of the composition.

Calcium silicide may be used as a grit to also increase sensitivity and as a fuel in combination with another fuel, such as antimony sulfide or other suitable fuel. Calcium silicide may be present in a range of about 5 to 20 percent by weight based on the total weight of the composition.

Alkali or alkaline earth nitrates, oxides, and peroxides (such as barium nitrate) may be employed as oxidizers. Oxidizers may be present in a range of about 20 to 60 percent by weight based on the total weight of the composition.

Fuel materials may include, but are not limited to, metals, such as aluminium, manganese, titanium, and zirconium; metal sulfides such as antimony sulphide; or other non-metallic materials. Fuel may be present in a range of about 10 to 40 percent by weight based on the total weight of the composition.

Common binders include, but are not limited to, nitrocellulose based shellacs, gum arabic/poly vinyl alcohol mixtures, and guar gum/poly vinyl alcohol mixtures. Binders may be present in a range of about 1 to 20 percent by weight based on the total weight of the composition.

Embodiments of the hot-wire igniter device include a bridgewire, an acceptor, and an output. Embodiments of the present invention contemplate, among other things, utilizing KDNP as the acceptor in place of other compounds, including, but not limited to, normal lead styphnate, basic lead styphnate, DDNP, and a number of pyrotechnics, such as ZPP (zirconium/potassium perchlorate).

Common bridgewire materials include tophet a, tophet c, and stainless steel. In certain embodiments, the type of current supplied to the bridgewire may include constant current or constant voltage, as well as current flow from a capacitor discharge. Embodiments of the present invention may include, but are not limited to, a variety of output formulations, such as $BKNO_3$, black powder, and Red Dot double base propellant.

Figure 1:
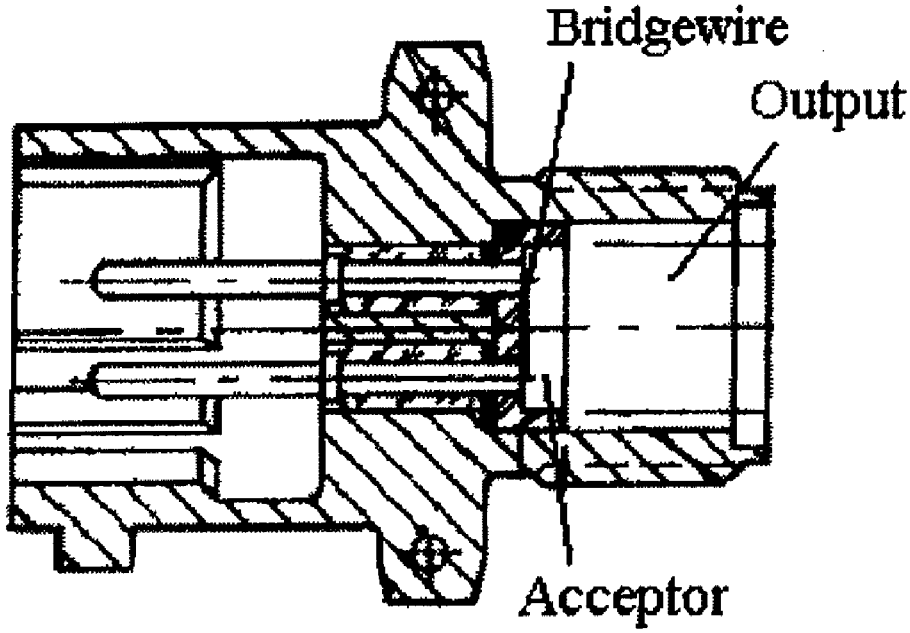
FIG. 1 is a cross-sectional view of a hot-wire igniter.
Figure 2:
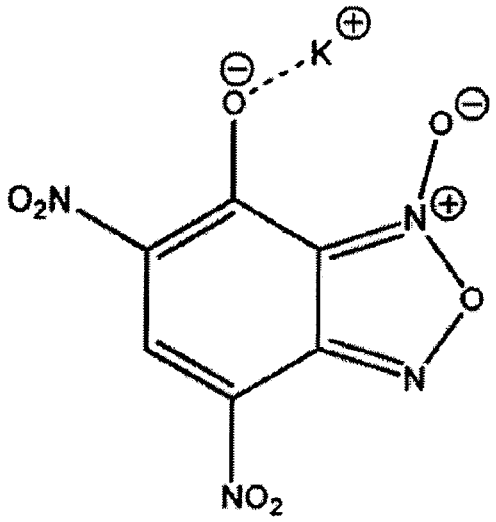
FIG. 2 is a structural representation of 4,6-dinitro-7-hydroxybenzofuroxan, potassium salt (KDNP).

DETAILED DESCRIPTION 4,6-dinitro-7-hydroxybenzofuroxan, potassium salt (KDNP, FIG. 1) is a primary explosive that has recently completed compound qualification testing as outlined in "Qualification and Final (Type) Qualification Procedures for Navy Explosives," Naval Sea Systems Command Instruction #8020.5C, 5 May 2000, ("NAVSEAINST 8020.5C") and has been investigated as a replacement for lead styphnate in a variety of applications. KDNP may conveniently be made via a three step process from m-bromoanisole in reasonable yield. See "Final Report on the Investigation of the Alternatives to Lead Azide and Lead Styphnate," NSWC-IH contract #N00174-06-C-0079, 20 Dec. 2007 and references therein. This material has been found to have stability, sensitivity and output characteristics that make it ideally suited as an alternative to lead styphnate or other similar material in both hot wire and primer applications.

A. Percussion Primers

Embodiments of the present invention describe a lead-free percussion primer mix in which the lead styphnate has been replaced with KDNP. Of primary interest is styphnate composition 5086 (NLS 5086), which finds wide use in military percussion primers, such as the PVU-12/A. This material is prepared according to NavAir drawing 851AS111 and consists of 2% tetracene (−45 sieve size per MIL-T-46938), 26% normal lead styphnate (−100 sieve size), 41.5% barium nitrate (−80 sieve size per MIL-B-162), 10.5% calcium silicide (−80 sieve per NavAir drawing 851AS112) and 20% antimony sulphide (−140, +325 sieve per MIL-A-158). These components are mixed as a slurry in either ethyl or isopropyl alcohol, dried at 60° C. for 48 hours, and then screened 3 times over a #40 sieve. In this composition, the normal lead styphnate functions as the primary initiating explosive due to high friction and impact sensitivity. Small amounts of tetracene are added to the mixture and serve to increase the sensitivity of the charge over that of lead styphnate alone. Calcium silicide acts as a grit to increase sensitivity and also as a fuel in conjunction with antimony sulphide. Barium nitrate acts as an oxidizer and ensures both a consistent and high temperature burn of the composition.

Any or all of these materials may be replaced with alternate compounds to afford the same result. As an example, the barium nitrate oxidizer may be replaced with an alkali or alkaline earth nitrate, oxide, or peroxide. Alternatively, the ratios or particle sizes of the components in the primer mixture may be altered to control various aspects of activity, such as sensitivity, burn rate, or output pressure. In addition, a binder is included during blending or when loading the primers to minimize dusting and to ensure consolidation of the primer mix. Common binders include nitrocellulose based shellacs, gum arabic/poly vinyl alcohol mixtures, or guar gum/poly vinyl alcohol mixtures.

In one embodiment, KDNP is used as a drop-in replacement for the primary explosive, normal lead styphnate, in the primer composition and was prepared using methods outlined in NavAir drawing 851AS111 with substitution of 26% KDNP for the NLS component (KDNP 5086).

PVU-12/A percussion primers with NLS 5086 composition were loaded per NavAir drawing 851AS400D and contained shellac solution as binder and 21±2 mg of primer mix followed by a paper disk and anvil. The composition height of 10 units was measured and this height was used to load the KDNP 5086 primers. The density of KDNP is substantially less than that of NLS (1.93 g/cc vs. 3.02 g/cc) so the KDNP based primers contain slightly more KDNP on a per mole basis. The primer units were dried/conditioned at 49° C. for 24 hours before testing. The percussion primer units (30 of each) were tested by pressing into .38 caliber shell casings and performing a F/NF test with a ball drop primer tester. The testing was carried out with a 3.3519 oz. ball bearing and varying the drop height from 0 to 12.5 inches according to a Neyer protocol. The results of these tests indicated that the KDNP based primers may be suitable as lead-free replacements for the standard lead styphnate containing PVU-12/A primers and that this primer mix may be applied to a wide range of percussion primers.

B. Hot-Wire Igniter Systems

In one embodiment, KDNP is used as a direct replacement for other hot-wire acceptors including, but not limited to, NLS, BLS, or ZPP. In extensive testing, KDNP has demonstrated hot-wire ignition characteristics that are very similar to or exceed both NLS and BLS. These characteristics include:

- constant current ignition times for KDNP, NLS, and BLS are nearly identical.
- closed bomb tests demonstrate that KDNP produces about seventy-five percent greater pressure than NLS on a weight basis.
- closed bomb results indicate that KDNP has a nearly twice as rapid pressure rise to peak when compared to NLS.

A summary of closed bomb data for KDNP vs. milled NLS is shown in Table I below.

TABLE I

| Sample | $T_0 - T_{P0}$ (ms) | $T_0 - T_{Pk}$ (ms) | $T_{P0} - T_{Pk}$ (ms) | Ignition Time* (ms) | Peak Pressure (psi) | Charge Weight (g) | Impetus (Inch lb/gm) |
|---|---|---|---|---|---|---|---|
| KDNP | 0.781 | 0.913 | 0.132 | 0.710 | 1480 | 0.149 | 6047 |
| n = 5 | 0.048 | 0.041 | 0.010 | 0.028 | | | |
| NLS | 0.785 | 1.034 | 0.250 | 0.734 | 1361 | 0.238 | 3488 |
| n = 5 | 0.045 | 0.035 | 0.020 | 0.045 | | | |

NOTE:
$T_0$-application of pulse,
$T_{P0}$-time to first indication of pressure,
$T_{Pk}$-time to peak pressure,
*first perturbation in current or voltage trace.

For these tests, appropriate hot-wire units were bridged with a 0.002" stainless bridgewire with a resistance of 1.10±0.2 ohms and the listed charge weight of KDNP or NLS was added to the unit and consolidated at 15 kpsi with a dwell time of 20 sec. The units were fired (5 A, 10 ms pulse) into a 10 cc closed bomb fixed with 2 pressure transducers situated perpendicular to the output of the unit. During firing, one transducer channel was recorded without any filtering and timing information was determined using this output. The other channel was filtered with a 2 k low-pass Butterworth filter, and pressure information was determined from this output. In some case, the peak pressures were calculated utilizing an additional 3 k low-pass Butterworth processing (software) filter to remove any stray ringing often seen in closed bomb data. In Table 1, mean values are shown in bold with standard deviations below where appropriate. Five closed bomb tests were run for each sample.

In addition to the closed bomb testing above, it was demonstrated that in hot-wire units, KDNP was equivalent to NLS in its ability to ignite a variety of pyrotechnics and propellant formulations including, as examples, BKNO3, black powder, or Red Dot double base propellant.

KDNP will also function in hot wire mode using a capacitor discharge as the energy source. As an example, KDNP, pressed at 5 kpsi onto a tophet c bridgewire, when pulsed with 1.0 microfarad (80-100 volts) using 0.0005" wire or 0.1 uf (160-180 volts) using 0.001" wire, will sustain ignition. The performance was not altered after exposure of the KDNP to 70° C. for 1 year. The calculated ignition energies are in the same region as those obtained for milled NLS.

An attractive feature of KDNP is high post fire resistance. Common bridgewire materials, such as NLS, BLS, and many pyrotechnic compositions such as ZPP or B/$CaCrO_4$, generally display low post-fire resistance due to deposition of vaporized conductive metal (lead, zirconium or chromium) during post-fire cooling. In many cases, this is undesirable as it may cause post-fire current drain on limited power sources, such as a battery. KDNP, with a potassium counter-ion, does not afford the opportunity for deposition of a conductive material.

An additional feature of KDNP, which may be beneficial for both primer and hot-wire applications, is flash suppression. Muzzle flash imparts a number of undesirable aspects, such as location signature, temporary loss of night vision and increased muzzle blast. The most widely used type of secondary flash suppression is via addition of alkali metal salts (usually potassium) directly to the propellant. See "Molecular Basis for Secondary Flash Suppression," Hastie, J. W., Bonnell, D. W. and Schenck, P. K., U.S. Army Research Office, Document ARO 18375-CH, MIPR 102-84, 1 Jul. 1986. The alkali metal acts as a catalyst in a free radical chain termination process that interrupts flame propagating radicals in a process similar to those used in fire suppression. In cases where the flash suppressant is added directly to the propellant, care must be taken to limit the amount so that output is not affected. Addition of KDNP to the primer and hot-wire acceptor augments the amount of potassium available for flash suppression with only very limited effect on the output.

The foregoing is provided for purposes of illustrating, explaining, and describing embodiments of the present invention. Modifications and adaptations to these embodiments will be apparent to those skilled in the art and may be made without departing from the scope or spirit of the invention.

The invention claimed is:

1. A primer for explosive materials comprising KDNP.

2. A primer for explosive materials omitting lead-based materials and comprising KDNP.

3. A lead-free primer composition comprising:

a) 10 to 50 percent by weight, based on the total weight of the composition, of KDNP;

b) 2 to 10 percent by weight, based on the total weight of the composition, of a sensitizer;

c) 20 to 60 percent by weight, based on the total weight of the composition, of an oxidizer;

d) 5 to 20 percent by weight, based on the total weight of the composition, of calcium silicide;

e) 10 to 40 percent by weight, based on the total weight of the composition, of a fuel; and f) 1 to 20 percent by weight, based on the total weight of the composition, of a binder.

4. The primer composition of claim 3, wherein the sensitizer is tetracene.

5. The primer composition of claim 3, wherein the oxidizer is selected from the group consisting of alkali nitrates, alkali oxides, alkali peroxides, alkaline earth nitrates, alkaline earth oxides, and alkaline earth peroxides.

6. The primer composition of claim 5, wherein the oxidizer is barium nitrate.

7. The primer composition of claim 3, wherein the fuel is a non-metal.

8. The primer composition of claim 3, wherein the fuel is a metal selected from the group consisting of aluminium, manganese, titanium, and zirconium.

9. The primer composition of claim 3, wherein the fuel is a metal sulfide.

10. The primer composition of claim 9, wherein the fuel is antimony sulfide.

11. The primer composition of claim 3, wherein the binder is selected from the group consisting of a nitrocellulose binder, gum arabic/poly vinyl alcohol mixture, and guar gum/poly vinyl alcohol mixture.

12. A lead-free primer composition comprising:

a) 10 to 50 percent by weight, based on the total weight of the composition, of KDNP;

b) 2 to 10 percent by weight, based on the total weight of the composition, of tetracene;

c) 20 to 60 percent by weight, based on the total weight of the composition, of barium nitrate;

d) 5 to 20 percent by weight, based on the total weight of the composition, of calcium silicide;

e) 10 to 40 percent by weight, based on the total weight of the composition, of antimony sulfide; and f) 1 to 20 percent by weight, based on the total weight of the composition, of a nitrocellulose binder.

13. A lead-free primer composition comprising:

a) 26 percent by weight, based on the total weight of the composition, of KDNP;

b) 2 percent by weight, based on the total weight of the composition, of tetracene;

c) 41.5 percent by weight, based on the total weight of the composition, of barium nitrate;

d) 10.5 percent by weight, based on the total weight of the composition, of calcium silicide;

e) 20 percent by weight, based on the total weight of the composition, of antimony sulfide; and f) a nitrocellulose binder.

14. The lead-free primer composition of claim 3, wherein KDNP is substituted in place of lead styphnate.

15. The lead-free primer composition of claim 14, wherein KDNP is substituted in an amount approximately equal to the weight of the lead styphnate to make the composition free of lead.

16. The lead-free primer composition of claim 12, wherein KDNP is substituted in place of lead styphnate.

17. The lead-free primer composition of claim 16, wherein KDNP is substituted in an amount approximately equal to the weight of the lead styphnate to make the composition free of lead.

18. The lead-free primer composition of claim 13, wherein KDNP is substituted in place of lead styphnate.

19. The lead-free primer composition of claim 18, wherein KDNP is substituted in an amount approximately equal to the weight of the lead styphnate to make the composition free of lead.

* * * * *